US008890058B2

(12) United States Patent
Takeuchi et al.

(10) Patent No.: US 8,890,058 B2
(45) Date of Patent: Nov. 18, 2014

(54) MASS SPECTROMETER

(75) Inventors: Sadao Takeuchi, Nagaokakyo (JP); Hiroaki Waki, Kyoto (JP); Li Ding, Manchester (GB); Roger Giles, West Yorkshire (GB)

(73) Assignee: Shimadzu Corporation, Kyoto (JP)

( * ) Notice: Subject to any disclaimer, the term of this patent is extended or adjusted under 35 U.S.C. 154(b) by 74 days.

(21) Appl. No.: 12/093,862

(22) PCT Filed: Nov. 16, 2005

(86) PCT No.: PCT/GB2005/004408

§ 371 (c)(1),
(2), (4) Date: May 15, 2008

(87) PCT Pub. No.: WO2007/057623

PCT Pub. Date: May 24, 2007

(65) Prior Publication Data

US 2008/0283742 A1 Nov. 20, 2008

(51) Int. Cl.
*H01J 49/00* (2006.01)
*H01J 49/06* (2006.01)

(52) U.S. Cl.
CPC ..... *H01J 49/067* (2013.01); *H01J 49/066* (2013.01)
USPC ..... 250/282; 250/281

(58) Field of Classification Search
USPC ..... 250/281, 282, 283, 286, 290, 292, 293
See application file for complete search history.

(56) References Cited

U.S. PATENT DOCUMENTS 6,111,250 A 8/2000 Thomson et al.
6,140,638 A 10/2000 Tanner et al.

(Continued)

FOREIGN PATENT DOCUMENTS

JP 6503679 A 4/1994
JP 11-510946 A 9/1999

(Continued)

OTHER PUBLICATIONS

Written Opinion of the International Searching Authority.

(Continued)

*Primary Examiner* — Jack Berman
*Assistant Examiner* — Hanway Chang
(74) *Attorney, Agent, or Firm* — Sughrue Mion, PLLC

(57) ABSTRACT

The present invention provides a mass spectrometer having an ion lens capable of transporting an ion having a large mass to charge ratio with a high level of ion-passing efficiency even under a low-vacuum atmosphere. In conventional atmospheric pressure ionization mass spectrometers or similar mass spectrometers, applying an excessively high voltage to the ion lens undesirably causes an electric discharge. Therefore, the passing efficiency for an ion having a large mass to charge ratio cannot be adequately improved, which leads to a poor detection sensitivity. To solve this problem, the mass spectrometer according to the present invention includes a voltage controller 21 that controls a variable radiofrequency (RF) voltage generator 24 so that both the amplitude and the frequency of the RF voltage applied to the lens electrodes of an ion lens 5 are changed according to the mass to charge ratio of an ion to be analyzed. This control enables the ion lens 5 to focus an ion and transport it to the subsequent stage with a high level of passing efficiency even in the case of analyzing an ion having a large mass to charge ratio. Thus, the detection sensitivity is improved. The aforementioned control is conducted on the basis of the control data stored in a voltage control data storage 22. These data are obtained in advance by a measurement of a sample containing a substance having a known mass to charge ratio, in which the intensity of the signal of an ion detector is maintained while the analysis conditions are changed.

19 Claims, 5 Drawing Sheets

(56) References Cited

U.S. PATENT DOCUMENTS

| | | | | |
|---|---|---|---|---|
| 6,462,338 | B1 | 10/2002 | Inatsugu et al. | |
| 2003/0001087 | A1 * | 1/2003 | Fuhrer et al. | 250/287 |
| 2005/0194543 | A1 * | 9/2005 | Hieke | 250/400 |

FOREIGN PATENT DOCUMENTS

| | | | |
|---|---|---|---|
| JP | 2000-149865 | A | 5/2000 |
| JP | 2002-526027 | A | 8/2002 |
| JP | 2003-512702 | A | 4/2003 |
| WO | 93/08590 | A1 | 4/1993 |
| WO | 97/07530 | A1 | 2/1997 |
| WO | 98/56030 | A1 | 12/1998 |
| WO | 02/48699 | A2 | 6/2002 |

OTHER PUBLICATIONS

Japanese Office Action dated Feb. 22, 2011 for corresponding Japanese Patent Application No. 2008-527495.

Decision of Dismissal of Amendment in corresponding Japanese Patent Application No. 2008-527495, dated Sep. 11, 2012.

Decision of Rejection in corresponding Japanese Patent Application No. 2008-527495, dated Sep. 11, 2012.

European Office Action dated Nov. 13, 2013 in European Patent Application No. 05803643.5.

* cited by examiner

MASS SPECTROMETER

TECHNICAL FIELD

The present invention relates to a mass spectrometer, and particularly to one suitably used in the field of biochemistry, or in the field of research, development or quality control of medicinal supplies, to carry out measurements for the purpose of genome-based drug discovery or pharmacokinetic tests, or to measure a trace of organic or inorganic principles, such as agricultural chemicals or environmental endocrine disrupters, or other substances present in the environment.

BACKGROUND ART

A type of mass spectrometers commonly used is the atmospheric pressure ionization mass spectrometer, which ionizes a sample under a gas pressure equal or approximate to the atmospheric pressure. Examples of this type include the electrospray ionization mass spectrometer (ESI-MS), the atmospheric chemical ionization mass spectrometer (APCI-MS), the atmospheric pressure matrix assisted laser desorption/ionization mass spectrometer (AP-MALDI-MS), the inductively coupled plasma mass spectrometer (ICP-MS) and the ion mobility spectrometry mass spectrometer (IMS-MS).

For example, in an electrospray ionization mass spectrometer, a liquid sample to be analyzed is sprayed from an electrospray nozzle into an ionization chamber maintained at or close to atmospheric pressure. The molecules of the sample turn into ions in the course of the evaporation of the solvent contained in the sprayed droplets. The ions thus produced are transported through one or more intermediate vacuum chambers into an analyzing chamber whose interior is maintained in a high-vacuum state. The analyzing chamber encloses, for example, a quadruple mass filter or a similar mass analyzer for separating the ions with respect to their mass to charge ratios. A detector then detects some of the ions thus separated.

The mass spectrometer having such a construction includes an ion lens, also called the ion optic, which accelerates and focuses energetic ions by means of electric fields. There are various types of ion lenses having different forms and constructions.

For example, the mass spectrometer disclosed in the U.S. Pat. No. 4,963,736 uses an ion lens composed of four pieces of rod electrodes to which only a radiofrequency (RF) voltage is applied. Another example is the mass spectrometer disclosed in the U.S. Pat. No. 6,744,047, which has six rod electrodes positioned around the ion beam axis and an RF voltage, superimposed on a DC voltage, is applied to the rod electrodes.

These types of ion lenses using rod electrodes are capable of focusing ions traveling through the space surrounded by the rod electrodes but not accelerating the ions along the ion beam axis. Therefore, if the ion lens is located in a low-vacuum atmosphere, or under a relatively high gas pressure, the ions can lose a significant proportion of their kinetic energy due to collisions with residual gas molecules. Some ions may even lose all their axial velocity before they have been transmitted through the ion optic. As a result, it is difficult to improve the ion transport efficiency of the ion lens.

In contrast, the mass spectrometer disclosed in the U.S. Pat. No. 6,462,338 uses an ion lens composed of multiple virtual rod electrodes positioned around the ion beam axis, where each of the virtual rod electrodes is composed of a plurality of separate metallic plate electrodes aligned in a row along the ion beam axis. Each of the plate electrodes constituting a single virtual rod electrode is fed with the same high frequency AC voltage superimposed on a different DC voltage. The DC voltage creates a DC electric field having a potential gradient along the ion beam axis so that ions are accelerated by the DC electric field. Thus, the mass spectrometer is capable of not only focusing the ions by means of the RF electric field but also accelerating the ions along the axis of the ion optic by means of the DC electric field, so that the ion transport efficiency is improved.

The behavior of an ion traveling through the electric field created by the ion lens depends on the mass to charge ratio of the ion. In general, an ion having a large mass to charge ratio is less affected by the electric field than an ion having a small mass to charge ratio. Therefore, for an ion having a large mass to charge ratio to be focused and transported with a high level of efficiency, it is necessary to create an axially accelerating electric field having a large potential drop. Taking this into account, the above-described mass spectrometer is constructed so that the RF voltage has a smaller peak to peak amplitude and the DC voltage is set lower for an ion having a smaller mass to charge ratio, whereas the amplitude of the RF voltage is set larger and the DC voltage is set higher for an ion having a larger mass to charge ratio.

However, under conditions where the vacuum is as low as that in the first intermediate vacuum chamber of an atmospheric pressure ionization mass spectrometer, an excessive increase in the amplitude of the high frequency AC voltage or in the DC voltage is liable to cause an electric discharge between adjacent electrodes. This means that the amplitude of the RF voltage and the DC voltage, respectively, have upper limits. The presence of such limits prevents the provision of appropriate conditions for an ion having a large mass to charge ratio to be efficiently focused and transported. As a result, the efficiency of transporting an ion through the ion optic and introducing said ion into the mass analyzer is lower for an ion having a large mass to charge ratio than for an ion having a small mass to charge ratio. This is one of the factors that lead to a reduction in the sensitivity of the analysis.

In recent years, mass spectrometers have widened their application areas to cover the research, development and quality control in the fields of biochemistry or production of medicinal supplies. Particularly, atmospheric pressure ionization mass spectrometers are becoming increasingly popular in the aforementioned fields because of the inherent advantages of the so-called soft ionization. Samples to be analyzed in the aforementioned fields typically consist of proteins, peptides or other substances that have large molar weights. Also, it is often the case that the sample contains only a trace of the component to be analyzed, so that the mass spectrometer needs to have a high level of sensitivity. However, as explained earlier, none of the conventional mass spectrometers have adequate sensitivity to an ion having a large mass to charge ratio. Therefore, a new mass spectrometer capable of the aforementioned measurement is now strongly demanded.

In light of the above-described situation, the present invention intends to provide a mass spectrometer constructed so that the transport efficiency for an ion having a large mass to charge ratio is improved and the sensitivity of the analysis is accordingly enhanced while maintaining the voltage (or amplitude of the voltage) applied to the ion lens at levels which preclude electrical breakdown.

DISCLOSURE OF THE INVENTION

To solve the above-described problem, the present invention provides a mass spectrometer including:

an ion source for generating ions;

a mass analyzer for separating the ions with respect to their mass to charge ratios; and an ion optic for focusing and introducing the ions into the mass analyzer, which is located on an ion path between the ion source and the mass analyzer, which is characterized by further including:

a voltage generator for applying at least a radiofrequency voltage to the ion optic; and a controller for changing the frequency of the radiofrequency voltage applied to the ion optic from the voltage generator, according to the mass to charge ratio of the ion transported by the ion optic.

The transmission efficiency of the ion optic depends not only on the amplitude of the RF voltage applied to the ion optic but also on the frequency of the RF voltage. With the amplitude maintained constant, the transmission efficiency for an ion having a larger mass to charge ratio becomes higher at a lower frequency. In the mass spectrometer according to the present invention, the controller includes a means for holding information about the relationship between the mass to charge ratio of the ion and the frequency of the RF voltage that yields a preferable (or if possible, optimal) transmission efficiency. The relationship of the RF frequency to mass to charge ratio should be determined before the analysis is carried out. When an analysis is carried out, the controller refers to the relationship information and controls the voltage generator to change the frequency of the RF voltage according to the mass to charge ratio of the ion that is to be transmitted through the ion optic. In general, the frequency of the RF voltage should be set lower at a time where an ion having a large mass to charge ratio is be transmitted or should be allowed to pass through. In contrast, it should be set higher at a time where an ion having a small mass to charge ratio is being transmitted or should be allowed to pass through.

More preferably, the controller may be constructed so that it changes both the frequency and the amplitude of the RF voltage according to the mass to charge ratio of the ion transported by the ion optic. In general, the frequency should be set lower and the amplitude should be set larger at a time when an ion having a larger mass to charge ratio is being transmitted or should be allowed to pass through. In contrast, the frequency should be set higher and the amplitude should be set smaller at a time where an ion having a smaller mass to charge ratio is being transmitted or should be allowed to pass through.

As described above, the mass spectrometer according to the present invention controls not only the amplitude but also the frequency of the RF voltage according to the mass to charge ratio of the ion that is to be transmitted through the ion optic. This control method is capable of allowing an ion having a large mass to charge ratio to pass through with a high level of efficiency while effectively minimizing the amplitude of the RF voltage so that electric discharge or similar problems are prevented. As a result, the number of ions to be analyzed increases even if they have a large mass to charge ratio and, accordingly, the number of ions reaching the detector after the mass separation also increases. Thus, the sensitivity of the analysis is improved.

In the mass spectrometer according to the present invention, the voltage generator may be constructed so that it generates a DC voltage in addition to the RF voltage and applies to the ion optic a voltage composed of the RF voltage superimposed on the DC voltage.

The impedance of the ion optic may change by changing the frequency of the RF voltage applied to the ion optic. This may also cause a change in the amplitude of the RF voltage. Preferably, the RF voltage is a rectangular wave. In the case of using the rectangular wave, which can be generated by switching, it has the advantage of being able to easily control the frequency, duty ratio, voltage level on the high-voltage side, voltage level on the low-voltage side or DC voltage level with CPU of a personal computer etc. Further, it has the advantage of being able to control the motion of the ion to be transported by arranging the voltage level on the high-voltage side and the voltage level on the low-voltage side asymmetrical with respect to the DC voltage.

In a form of the present invention, the mass spectrometer further includes:

a storage means for storing information representing the relationship between the mass to charge ratio of the ion to be analyzed and the frequency of the RF voltage corresponding to it; and a means for predetermining the aforementioned relationship between mass to charge ratio and the RF frequency obtained as a result of previous mass analysis' carried out using a sample containing one or more components with known mass to charge ratios, for various frequencies of the RF voltage applied to the ion optic, and storing the information into the storage means, and the controller means for controlling the frequency of the RF voltage according to the information stored in the storage means when a target sample is analyzed.

According to this invention, the frequency of the RF voltage is controlled so that the transmission efficiency is optimized, according to the state of the mass spectrometer at that point in time. Therefore, a high level of sensitivity is always attained, even for the analysis of an ion having a large mass to charge ratio. Also, the invention makes the analysis easy and less troublesome by automatically collecting information necessary for controlling the frequency of the RF voltage without requiring users to carry out any additional time-consuming operations.

In a form of the present invention, the ion optic has a multi-stage structure in which M groups of electrodes, each group consisting of N pieces of thin plate electrodes arranged around the ion beam axis on a plane whose normal is parallel to the ion beam axis, are located apart from each other along the ion beam axis, where M is an integer greater than or equal to two, and N is an even number greater than or equal to four.

This construction allows different DC voltages to be applied to the electrodes lying on the multiple planes located along the ion beam axis so that an electric field having a potential gradient along the ion beam axis is created within the ion optic to accelerate ions. Thus, the ion-transport efficiency is further improved.

Each of the above-described ion optic may be used in various types of mass spectrometers. Particularly, it is suitable for efficiently transporting ions within a condition in which the vacuum degree is relatively low and there is a considerable influence from the molecules of a residual gas. For example, the ion optic may be used in a mass spectrometer including:

an ion source with an ionization chamber for ionizing a sample under atmospheric pressure;

an analyzing chamber in which a mass analyzer is set under a high-vacuum atmosphere; and one or more intermediate vacuum chambers located between the ionization chamber and the analyzing chamber and partitioned by walls, and the ion optic is located in the at least one of the vacuum chambers, preferably in one closer to the ionization chamber.

DESCRIPTION OF NUMERALS

1 . . . Ionization Chamber
2 . . . Nozzle
3 . . . Desolvating Pipe
4 . . . First Intermediate Vacuum Chamber
5 . . . First Ion Lens
51, 52, 53, 54, 511, 521, 531, 541, 521, 522, 523, 524 . . . Lens Electrodes
6 . . . Skimmer
7 . . . Orifice
8 . . . Second Intermediate Vacuum Chamber
9 . . . Second Ion Lens
10 . . . Wall
11 . . . Analyzing Chamber
12 . . . Quadrupole Mass Filter
13 . . . Ion Detector
14 . . . Rotary Pump
15, 16 . . . Turbo Molecular Pump
20 . . . Central Controller
21 . . . Voltage Controller
22 . . . Voltage Control Data Storage
23 . . . Variable DC Voltage Generator
24 . . . Variable RF Voltage Generator
25 . . . Adder
26 . . . Power Source

DETAILED DESCRIPTION OF A PREFERRED EMBODIMENT

Figure 1:
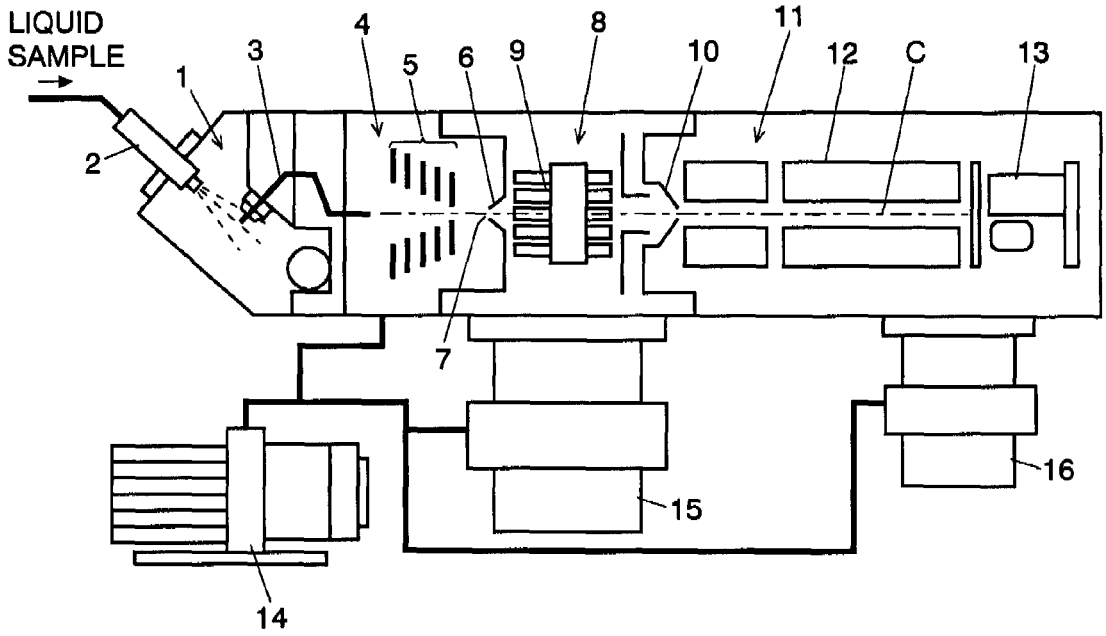
FIG. 1 is a diagram showing the overall construction of an electrospray ionization mass spectrometer as an embodiment of the present invention.

As an embodiment of the mass spectrometer according to the present invention, an electrospray ionization mass spectrometer (ESI-MS) is described with reference to the attached drawings. FIG. 1 is a diagram showing the overall construction of the ESI-MS.

In FIG. 1, the mass spectrometer includes an ionization chamber 1 having a nozzle 2 connected to the exit end of the column of a liquid chromatograph (not shown) or a similar device, an analyzing chamber 11 enclosing a quadrupole mass filter 12 as the mass analyzer and an ion detector 13, and a first intermediate vacuum chamber 4 and a second intermediate vacuum chamber 8 partitioned by walls between the ionization chamber 1 and the analyzing chamber 11. The ionization chamber 1 and the first intermediate vacuum chamber 4 communicate with each other through a desolvating pipe 3 of a small diameter. The first intermediate vacuum chamber 4 and the second vacuum chamber 8 communicate with each other through a skimmer 6 having a minuscule orifice 7 formed at the tip of the conic section.

The ionization chamber 1 as the ion source is continuously supplied with gas molecules produced from the sample solution coming from the nozzle 2 and a nebulizing gas, such as the nitrogen gas, supplied from a nebulizer (not shown) so that internally it is maintained roughly at atmospheric pressure (about $10^5$ Pascal). At the next stage, the inside of the first intermediate vacuum chamber 4 is evacuated by a rotary pump 14 to create a low-vacuum state of about $10^2$ Pascal. At the third stage, the inside of the second intermediate vacuum chamber 8 is evacuated by a turbo molecular pump 15 to create a medium vacuum state of about $10^{-1}$ to $10^{-2}$ Pascal. Finally, the interior of the analyzing chamber 11 is evacuated by another turbo molecular pump 16 to create a high vacuum state of about $10^{-3}$ to $10^{-4}$ Pascal. In summary, this ESI-MS has a multi-stage differential pumping system that increases the vacuum degree of each chamber from the ionization chamber 1 to the analyzing chamber 11 in a stepwise manner to maintain the high vacuum state within the analyzing chamber 11 at the final stage.

The operation of the present ESI-MS is outlined below. With the help of the nebulizing gas, the sample solution is sprayed into the ionization chamber 1, receiving electric charges from the tip of the nozzle 2. Then, when the solvent contained in each droplet evaporates and the droplet is broken into minute particles, the sample molecules are ionized. The minute particles mixed with ions are drawn into the desolvating pipe 3 due to the pressure difference between the ionization chamber 1 and the first intermediate vacuum chamber 4. This pipe 3, heated by a heater (not shown), helps the solvent to further evaporate from the particles, thereby promoting to the ionization.

The first intermediate vacuum chamber 4 encloses a first ion lens 5. This lens 5 generates an electric field that helps the introduction of the ions through the desolvating pipe 3 into the first intermediate vacuum chamber 4 and focuses the ions onto the orifice 7 of the skimmer 6. This means that the ion lens 5 has a focus located at or in the vicinity of the orifice 7. The ions that have passed through the orifice 7 and entered the second intermediate vacuum chamber 8 are focused by the second ion lens 9, which is an octopole lens composed of eight rod electrodes. The focused ions are transported through the opening formed in the wall 10 into the analyzing chamber 11.

In the analyzing chamber 11, only a specific kind of ion that has a specific mass to charge ratio is allowed to pass through the quadruple mass filter 12 along its longitudinal axis; ions having different mass to charge ratios diverge from the axis halfway through their transmission. Thus, an ion having a specific mass to charge ratio is selected. The ion that has passed through the quadrupole mass filter 12 reaches the ion detector 13, which generates an ion detection signal whose intensity indicates the amount of the ion received. In general, the quadrupole mass filter 12 is supplied with a voltage composed of an RF voltage superimposed on a DC voltage, and the mass to charge ratio of the ion passing through the quadrupole mass filter 12 can be scanned by changing the voltage. Accordingly, the mass to charge ratio is scanned within a predetermined range by scanning the corresponding range of the voltage, and the detection signal of the ion detector 13 is processed in a predetermined manner to create a mass spectrum for the predetermined range of the mass to charge ratio.

In the above-described construction, the first and second ion lenses 5 and 9 both transport ions to subsequent stages while focusing the ions to the longitudinal axis. The ESI-MS in the present embodiment is particularly featured by the construction and operation of the first ion lens 5 located in the first intermediate vacuum chamber 4 and the control system for driving the first ion lens 5. Except for the ionization chamber 1 that is maintained at about atmospheric pressure, the first intermediate vacuum chamber 4 is the section where the vacuum degree is at the least efficient level within the ESI-MS. In this chamber, the ions have a high possibility of colliding with residual gas molecules, so that the efficiency of focusing and transporting ions is hard to improve. The presence of the molecules of a residual gas also has an undesirable effect: an electric discharge is liable to occur if too high a voltage is applied to the ion lens. The structure adopted hereby improves the efficiency of focusing and transporting ions even under such an undesirable condition.

Figure 2:
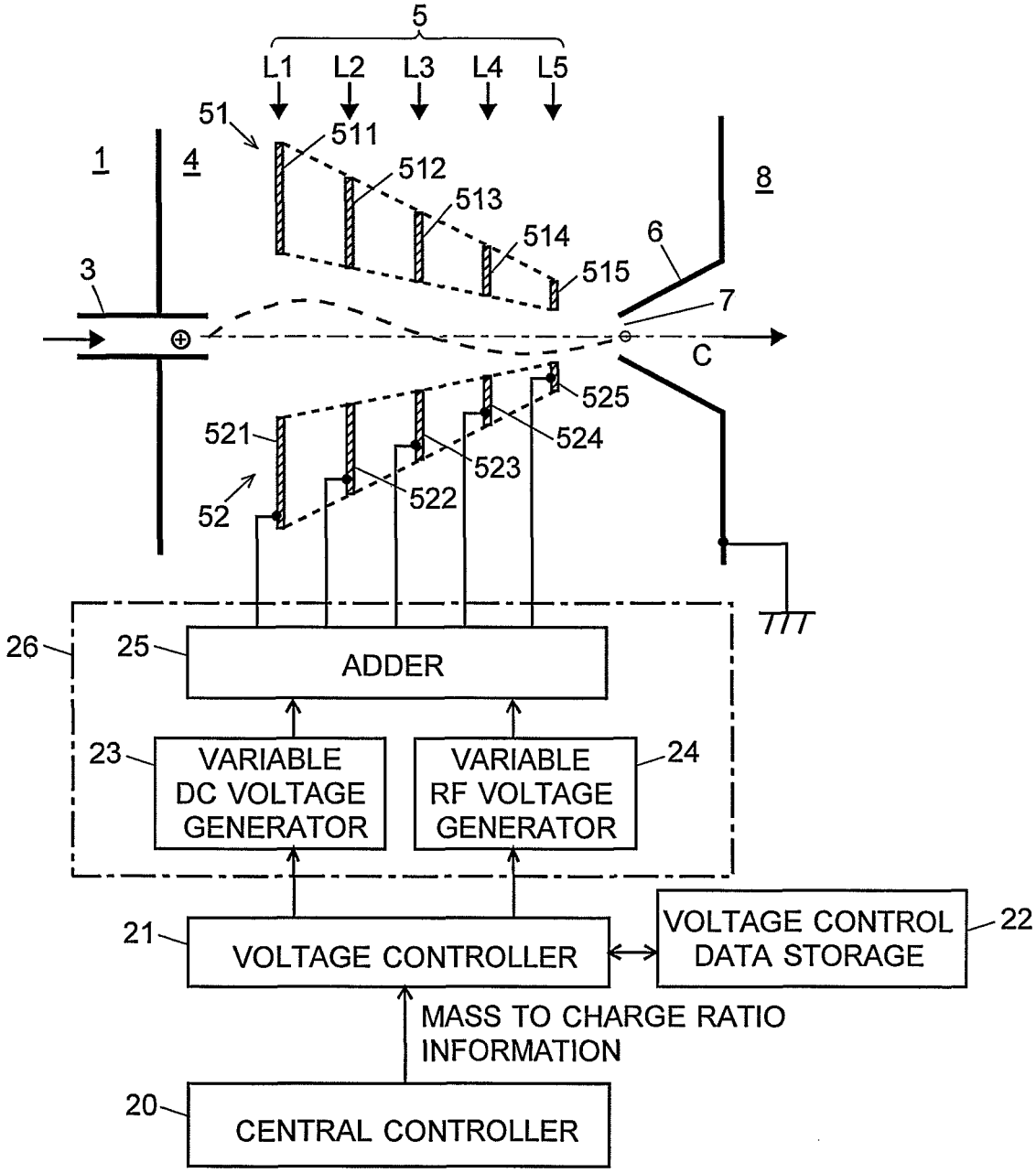
FIG. 2 is a diagram showing the construction of the ion optic and related components of the mass spectrometer in the embodiment.
Figure 3:
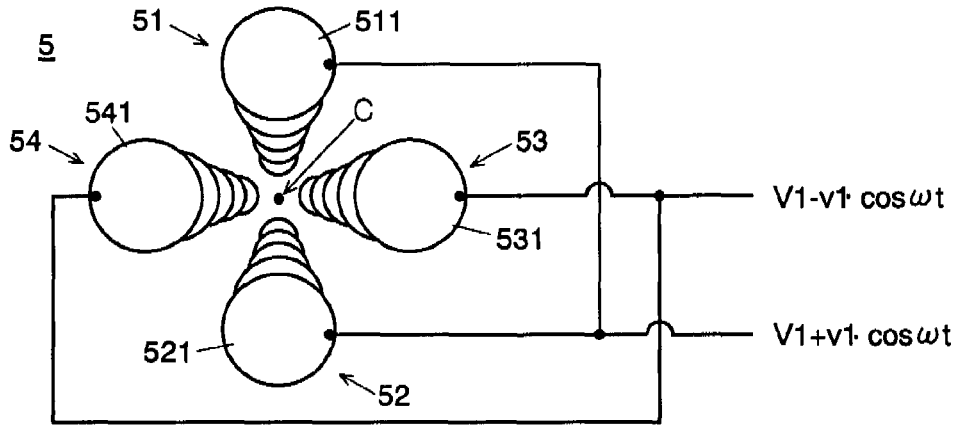
FIG. 3 is a schematic diagram of the ion optic in FIG. 2, viewed from the incidence side for ions.

FIG. 2 is a diagram showing the construction of the ion optic and related components of the mass spectrometer in the embodiment, and FIG. 3 is a schematic diagram of the ion optic in FIG. 2, viewed from the incidence side for ions.

The first ion lens 5 is composed of twenty pieces of lens electrodes arranged into five lens groups aligned along the ion beam axis C at substantially equal intervals. Each lens group consists of four pieces of the lens electrodes positioned around the ion beam axis C at angular intervals of 90 degrees on a plane (L1, L2, L3, L4 or L5 in FIG. 2) substantially perpendicular to the ion beam axis C. Five pieces of the lens electrodes aligned along the ion beam axis (i.e. the advancing direction of the ions), e.g. the electrodes 511, 512, 513, 514 and 515, can be regarded as constituting a virtual rod electrode. This means that the first ion lens 5 can be regarded as being composed of four pieces of virtual rod electrodes positioned around the ion beam axis C.

The above-described arrangement of the lens electrodes constituting the first ion lens 5 is basically disclosed in the U.S. Pat. No. 6,462,338 aforementioned earlier. The above-described construction is a quadrupole type in which each lens group consists of four pieces of lens electrodes. Otherwise, the lens group may have any other number of lens electrodes as long as it is an even number greater than four, such as a hexapole type having six electrodes or an octopole type having eight electrodes. Also, the number of lens groups may be any number greater than two. Each lens electrode may have a different shape: the minimal requirement is that the section of the lens electrode facing the ion beam electrode should be shaped circular or parabolic.

In the four pieces of lens electrodes constituting a single lens group, each pair of the electrodes opposing across the ion beam axis are wired to each other so that the same voltage is applied to them. Taking the first lens group shown in FIG. 3 as an example, the lens electrodes 511 and 521 are connected to each other, and the other two, 531 and 541, constitutes the second connected pair. The other lens electrodes included in the other lens groups located behind the first one are also wired in a similar manner.

As shown in FIG. 2, the control circuit for driving the first ion lens 5 includes a power source 26 having a variable DC voltage generator 23 for generating DC voltages, a variable RF voltage generator 24 for generating RF voltages and an adder 25 for adding (or superimposing) the RF voltage on the DC voltage. The voltage resulting from the superimposition is applied to each lens electrode of the first ion lens 5. The DC voltage generated by the variable DC voltage generator 23, and the frequency and the amplitude of the RF voltage generated by the variable RF voltage generator 24, are controlled by a voltage controller 21 on the basis of the control data stored in the voltage control data storage means 22. The control circuit includes another controller, i.e. the central controller 20, which comprehensively controls the voltages applied to the quadrupole mass filter 12 and other variables except for the voltage applied to the first ion lens 5. The central controller 20 also supplies the voltage controller 21 with information relating to the mass to charge ratio of the ion to be analyzed. Upon receiving this information, the voltage controller 21 loads from the voltage control data storage 22 a control data set corresponding to the mass to charge ratio indicated by the information supplied by the central controller 20. The voltage controller controls the variable DC voltage generator 23 and the variable RF voltage generator 24 on the basis of the control data so that the voltage source 26 applies a predetermined voltage to each lens electrode of the first ion lens 5.

The voltage applied from the voltage source 26 to each lens electrode is described, on the assumption that the ion analyzed hereby is a positive ion.

Figure 4:
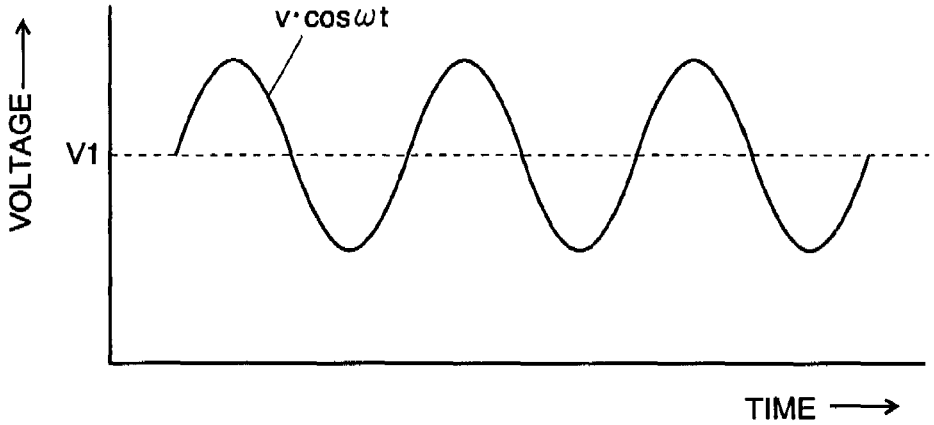
FIG. 4 is a graph showing an example of the waveform of the voltage applied to the lens electrodes of the ion optic used in the mass spectrometer in the embodiment.

Among the four lens electrodes arranged on each plane Ln (n=1, 2, . . . , 5) shown in FIG. 2, a pair of the lens electrodes opposing each other across the ion beam axis are supplied with a voltage $Vn+v \cos \omega t$ generated by the variable DC voltage generator composed of the RF voltage $v \cos \omega t$ generated by the variable RF voltage generator superimposed on the DC voltage Vn generated by the variable DC voltage generator. In contrast, the other pair of the lens electrodes lying on the same plane Ln are supplied with a voltage $Vn-v \cos \omega t$ composed of the RF voltage $-v \cos \omega t$ superimposed on the DC voltage Vn. The two RF voltages applied to the two pairs are identical in amplitude and frequency, but their phases are inverted relative to each other, or shifted from each other by 180 degrees. For example, the lens electrodes 511 and 521 lying on plane L1 shown in FIG. 3 are supplied with a voltage $V1+v \cos \omega t$ composed of the RF voltage $v \cos \omega t$ superimposed on the DC voltage V1, whereas the other two lens electrodes 531, 541 belonging to the same group a voltage $V1-v \cos \omega t$ composed of the RF voltage $-v \cos \omega t$ superimposed on the DC voltage V1. FIG. 4 shows an example of the waveform of the voltage applied to the lens electrodes 511 and 521.

Figure 5:
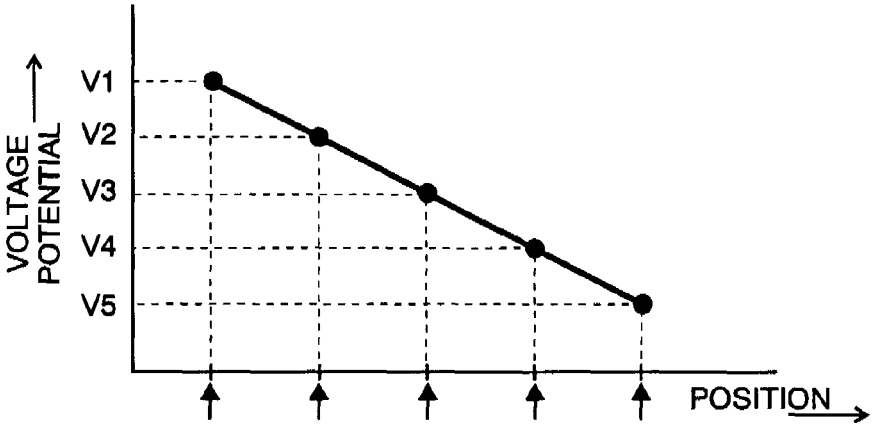
FIG. 5 is a graph for conceptually illustrating the potential gradient created by the DC voltage within the ion optic used in the mass spectrometer in the embodiment.

The speed of the ion introduced into the space surrounded by the lens electrodes of the first ion lens 5 is primarily influenced by the DC electric field. Taking this into account, the DC voltages Vn (n=1, 2, . . . , 5) are determined so that an electric field which accelerates the ion is created in the space surrounded by the first ion lens 5. In the case of analyzing a positive ion, for example, the DC voltages are regulated as $V1>V2>V3>V4>V5$ so the voltage decreases in a stepwise manner as the ion travels toward the orifice 7, as shown in FIG. 5. It should be noted that the DC voltages are not always required to fall in every step from one stage to the next. For example, it is allowable to equalize the voltages V1, V2 and V3 and decrease V4 and V5 stepwise, as $V1=V2=V3>V4>V5$. In the case of analyzing a negative ion, the magnitude of the gradient of the DC voltage should be changed according to the change in the polarity of the ion.

Even if the gradient of the DC voltage is the same, the degree of acceleration of an ion passing through the first ion lens 5 changes depending on the mass to charge ratio of the ion. Therefore, the DC voltages Vn should be changed according to the mass to charge ratio of the target ion. The "target ion" hereby means the ion that is intended to be selected with the quadrupole mass filter 12 at the moment. The best strategy is to set the DC voltages Vn so that the passing efficiency for the ion that is about to be selected by the quadrupole mass filter 12 is maximized when the ion passes through the first ion lens 5.

The focus of the ion introduced into the space surrounded by the lens electrodes of the first ion lens 5 is primarily influenced by the RF electric field. The RF voltage applied to each lens electrode at a given point in time is identical in amplitude ν and frequency ω. What features the mass spectrometer in this embodiment is that it controls both the amplitude ν and the frequency ω depending on the mass to charge ratio of the target ion, as opposed to conventional mass spectrometers that control only the amplitude ν.

Figure 6:
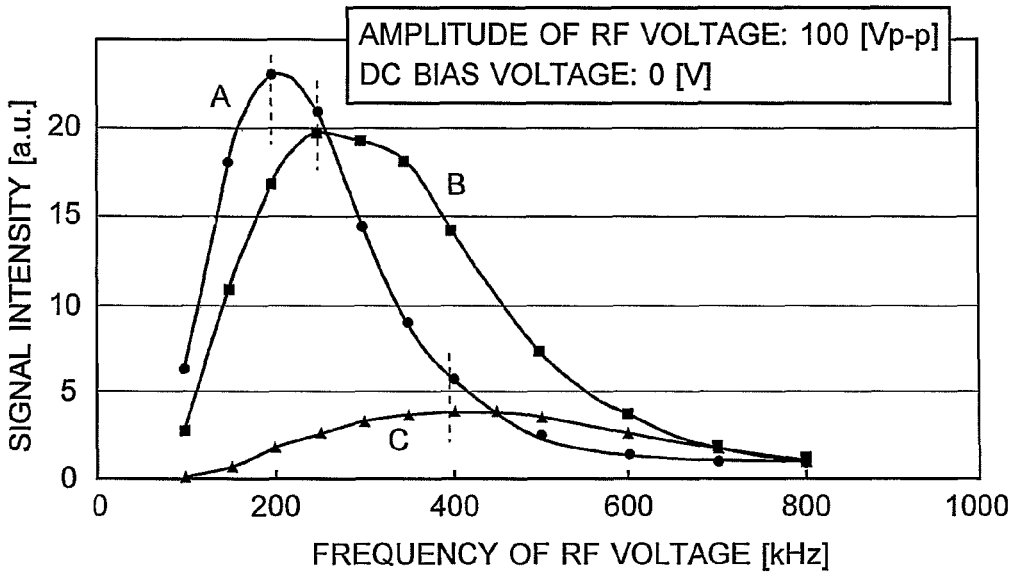
FIG. 6 is a graph for describing the process of controlling the ion optic used in the mass spectrometer in the embodiment.

FIG. 6 is a graph showing the result of observing the relationship between the frequency of the RF voltage and the intensity of the detection signal of the ion detector for three kinds of ions having different mass to charge ratios. The three ion species, A, B and C have mass to charge ratios Ma, Mb and Mc, respectively, which agree with the relationship Ma>Mb>Mc. This graph shows that the frequency that maximizes the intensity of the detection signal within each curve decreases as the mass to charge ratio of the ion increases. This means that the transmission efficiency of the first ion lens 5 depends on the frequency of the RF voltage, and the dependency varies with the mass to charge ratio. Taking this into account, the mass spectrometer in the present embodiment changes both the frequency and the amplitude of the RF voltage to improve the transmission efficiency according to the mass to charge ratio, as opposed to the conventional method that changes only the amplitude of the RF voltage while maintaining the same frequency. This operation can attain a higher transmission efficiency while reducing the increase in the amplitude.

More specifically, in the mass spectrometer in the present embodiment, the voltage controller 21 controls the voltages driving the first ion lens 5 by changing the following parameters according to the mass to charge ratio of the target ion: DC voltages, Vn (n=1, 2, . . . , 5); amplitude ν of RF voltage; and frequency ω of RF voltage. This control operation uses the control data stored in the voltage control data storage 22, taking into account the ionization condition or any other analysis condition that influences the optimal transmission efficiency for a given mass to charge ratio. In general, a mass spectrometer carries out an automatic tuning operation to optimize the parameters of its components in advance of the analysis of a target sample. It is preferable to create the aforementioned control data and store them in the voltage control data storage means 22 in the course of the automatic tuning operation.

Figure 7:
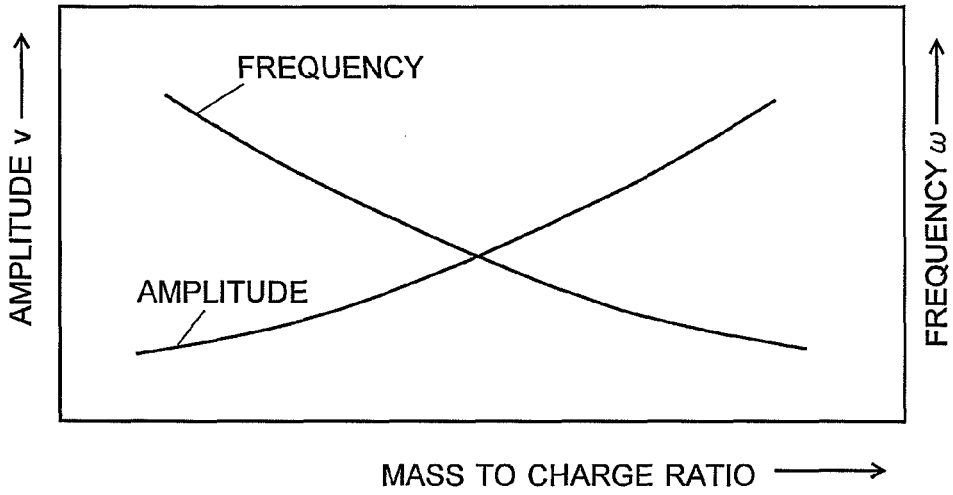
FIG. 7 is a graph for describing the process of controlling the ion optic used in the mass spectrometer in the embodiment.

In this case, when an operator enters a command for starting the automatic tuning, the controller 20 controls each component of the mass spectrometer so that a standard sample containing a substance having a known mass to charge ratio is introduced and the mass analysis operation is repeated while the analysis conditions for the components are changed. Taking the first ion lens 5 as an example, the mass analysis of the standard substance is repeated while the aforementioned parameters are changed, and the intensity of the detection signal for the standard substance is calculated for each setting of the parameters. From the results of the analyses, a parametric setting that gives the largest signal intensity is chosen, from which a set of control data for controlling each of the following parameters is created: DC voltages Vn, amplitude ν of RF voltage, and frequency ω of RF voltage. For example, on the basis of the result of analyses of plural standard substances having different mass to charge ratios, the relationships between the mass to charge ratio and the amplitude and the frequency of the RF voltage are estimated, as indicated by the curves in FIG. 7, and a set of control data representing the curves are calculated. In the mass analysis of a target sample, the voltage controller 21 references the control data to determine appropriate values for the amplitude and the frequency of the RF voltage from the mass to charge ratio of the target ion, and controls the variable RF voltage generator 24 using the determined values.

Thus, in the mass spectrometer in this embodiment, not only the amplitude but also the frequency of the RF voltage applied to the lens electrodes of the first ion lens 5 are controlled according to the mass to charge ratio of the target ion. This method helps to create an almost ideal condition for the ion to efficiently focus and be transmitted compared to the conventional method where only the amplitude is controlled. Furthermore, the undesirable electric discharge can be prevented even under a low-vacuum atmosphere because the amplitude of the RF voltage can be maintained below an adequately low level.

It should be noted that the above-described embodiment is a mere example of the present invention. For those skilled in the art, it is possible to further change, modify or extend the embodiment within the spirit and scope of the present invention as described in the claims of the present application.

Figure 8A:
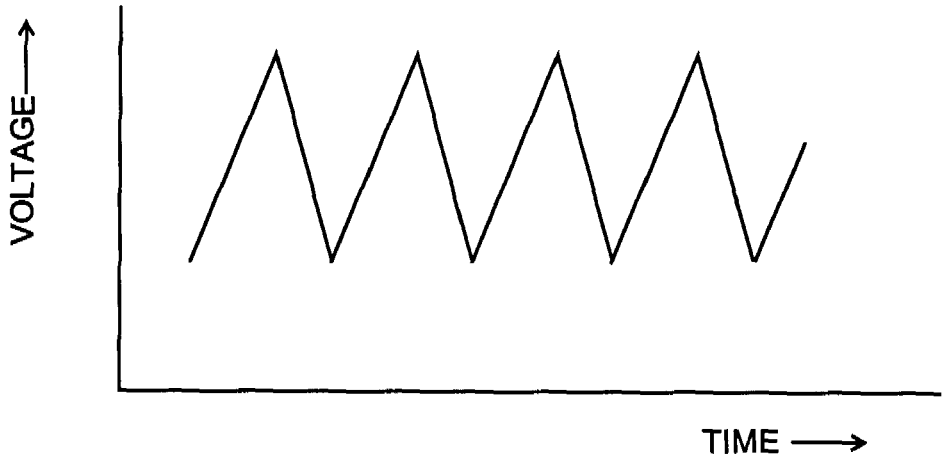
FIGS. 8A and 8B are graphs showing other examples of the waveform of the voltage applied to the lens electrodes of the ion optic used in the mass spectrometer in the embodiment.
Figure 8B:
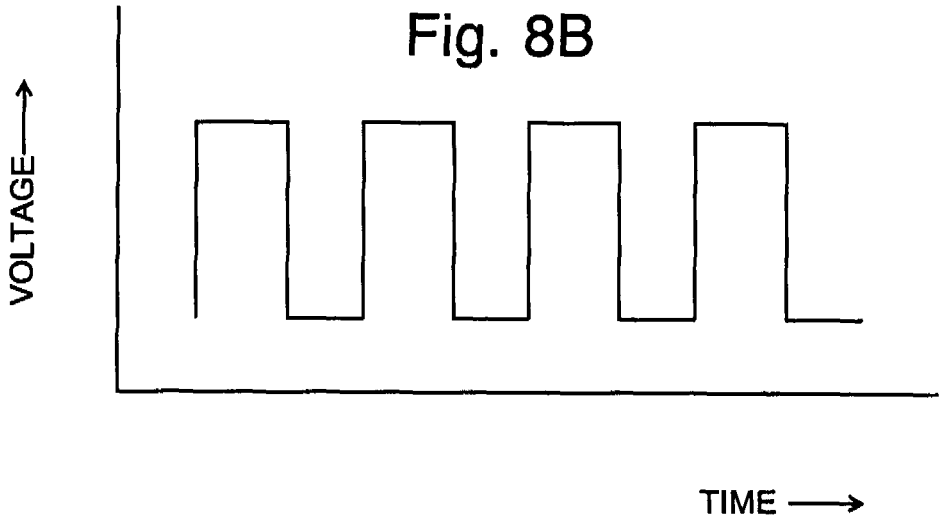

For example, the waveform of the RF voltage applied to the lens electrodes of the first ion lens 5, which is sinusoidal in the previous embodiment, may be changed. Examples include a triangular wave, a rectangular wave and a sawtooth wave as shown in FIGS. 8A and 8B. Otherwise, two or more of these waves may be serially combined to create a complex waveform. In the case the RF voltage is a sinusoidal wave, the variable RF voltage generator 24 employ an LC resonant circuit or a similar element to generate an RF signal having a variable frequency. In the case the RF voltage is a rectangular wave, a digital synthesizer circuit may be used instead of the analogue circuit to generate an RF voltage having a variable frequency. Use of the digital synthesizer circuit, which is smaller in size, is advantageous to making the apparatus smaller and lighter.

The previous embodiment has such a construction where the plurality of plate electrodes constitute a single virtual rod electrode. The virtual rod electrode may be replaced by a real rod electrode. In this construction, to an even number greater than two (e.g. four, six and eight) of the rod electrodes positioned around the ion beam axis, appropriate DC voltages whose value is different from that of DC voltages applied to components located before and/or after the electrodes are applicable so as to accelerate the ions. Further, different DC voltages are respectively applicable to multiple groups of electrodes located along the ion beam axis, each group consisting of an even number greater than two (e.g. four, six and eight) of the rod electrodes positioned around the ion beam axis so as to accelerate the ions.

In the previous embodiment, the present invention is applied to the first ion lens 5 enclosed in the first intermediate vacuum chamber 4. It is also possible to apply the present invention to the ion lens located within the second intermediate vacuum chamber 8 having a higher vacuum degree. Of course, the present invention is applicable to both the first ion lens 5 and the ion lens of the vacuum chamber 8 at a time. When more than two intermediate vacuum chambers are provided, it is possible to apply the present invention to the ion lens located in the at least one of the vacuum chambers. Finally, it should be understood that the present invention is applicable to other types of mass spectrometers as well as an ESI-MS and an AP-MALDI-MS.

The invention claimed is:

1. A mass spectrometer, comprising:

an ion source for generating ions;

a mass analyzer for separating the ions with respect to their mass to charge ratios;

an ion lens for focusing the ions to an ion optical axis and introducing the ions into the mass analyzer, which is located on an ion path between the ion source and the mass analyzer;

a voltage generator for applying at least a radio frequency voltage to the ion lens; and a controller for changing a frequency of the radio frequency voltage applied to the ion lens from the voltage generator to a frequency that maximizes an intensity of a detection signal by maximizing the ions focused to the ion optical axis according to the mass to charge ratio range of the ion transported by the ion lens.

2. The mass spectrometer according to claim 1, which is characterized in that the controller changes both the frequency and the amplitude of the radio frequency voltage according to the mass to charge ratio of the ion to be transported.

3. The mass spectrometer according to claim 2, which is characterized in that the voltage generator also generates a DC voltage in addition to the radio frequency voltage, and applies to the ion lens a voltage composed of the radio frequency voltage superimposed on the DC voltage.

4. The mass spectrometer according to claim 3, which is characterized in that the radio frequency voltage is a rectangular wave.

5. The mass spectrometer according to claim 3, which is characterized in that the ion lens has a multi-stage structure in which M groups of electrodes, each group consisting of N pieces of thin plate electrodes arranged around the ion beam axis on a plane whose normal is parallel to the ion optical axis, are located apart from each other along the ion beam axis, where M is an integer greater than or equal to two and N is an even number greater than or equal to four.

6. The mass spectrometer according to claim 3, which is characterized in that the ion lens is constructed so that N pieces of rod electrodes extending parallel to the ion optical axis are arranged around the ion beam axis, where N is an even number greater than or equal to four.

7. The mass spectrometer according to claim 6, which is characterized in that the voltage generator applies DC voltages to the N pieces of electrodes, whose value is different from that of DC voltages applied to a preceding component and/or a following component of the N pieces of electrodes, to accelerate the ions.

8. The mass spectrometer according to claim 6, which is characterized in that the ion lens is constructed so that multiple groups of electrodes, each group consisting of the N pieces of rod electrodes, are located along the ion beam axis, and the voltage generator applies different DC voltages to each group of electrodes, to accelerate the ions.

9. The mass spectrometer according to claim 5, which is characterized in that the voltage generator applies two or more DC voltages to the M groups of electrodes located apart from each other along the ion optical axis and constituting the multi-stage structure, to accelerate the ions.

10. The mass spectrometer according to claim 1, which further comprises:

a storage for storing information representing the relationship between the mass to charge ratio of the ion to be analyzed and the frequency of the radio frequency voltage; and an information-presetting manager for creating the aforementioned information from the result of a mass analysis carried out using a sample containing one or more components with known mass to charge ratios, for various frequencies of the radio frequency-voltage applied to the ion lens, and storing the information into the storage, and the controller controls the frequency of the radio frequency voltage according to the information stored in the storage when a target sample is analyzed.

11. The mass spectrometer according to claim 1, which further comprises:

an ion source for ionizing a sample under atmospheric pressure;

an analyzing chamber in which a mass analyzer is set under a high-vacuum atmosphere; and one or more intermediate vacuum chambers located between the ionization source and the analyzing chamber and partitioned by walls, and the ion lens is located in the at least one of the intermediate vacuum chambers.

12. The mass spectrometer according to claim 11, which is characterized in that the ion lens is enclosed in the vacuum chamber located next to the ionization source.

13. The mass spectrometer according to claim 12, which is characterized in that the ions are transported from the ionization source to the vacuum chamber located next to the ionization chamber through a heated capillary pipe, and the ions transported through the capillary pipe is introduced into the ion lens within the intermediate vacuum chamber.

14. The mass spectrometer according to claim 11, which is characterized in that a skimmer having a hole formed at a tip of its conic section is located behind the ion lens, and an ion that has passed through the ion lens is sent through the hole of the skimmer to either a next intermediate vacuum chamber or the analyzing chamber.

15. The mass spectrometer according to claim 14, which is characterized in that the ion lens has a focus located at or in the vicinity of the hole of the skimmer.

16. The mass spectrometer according to claim 1, wherein the mass analyzer comprises a quadrupole mass filter and the controller controls voltages applied to the quadruple mass filter.

17. The mass spectrometer according to claim 1, wherein a space enclosed by the ion lens has a diameter which becomes smaller toward an outlet end.

18. The mass spectrometer according to claim 1, wherein the frequency of the radio frequency voltage is from 100 kHz to 800 kHz.

19. The mass spectrometer according to claim 1, wherein the frequency changed by the controller is lower when an ion having a larger mass to charge ratio is transmitted or passed through and the frequency changed by the controller is higher when an ion having a smaller mass to charge ratio is transmitted or passed through.

* * * * *